US011096537B2

(12) United States Patent
Blackwell, Jr. et al.

(10) Patent No.: US 11,096,537 B2
(45) **Date of Patent: *Aug. 24, 2021**

(54) VACUUM BAG

(71) Applicant: SHOP VAC CORPORATION, Williamsport, PA (US)

(72) Inventors: James P. Blackwell, Jr., Williamsport, PA (US); Robert Lent Crevling, Jr., Williamsport, PA (US); Jonathan Miller, Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 301 days.

This patent is subject to a terminal disclaimer.

(21) Appl. No.: 16/213,794

(22) Filed: Dec. 7, 2018

(65) Prior Publication Data

US 2019/0104902 A1 Apr. 11, 2019

Related U.S. Application Data

(63) Continuation of application No. 14/295,025, filed on Jun. 3, 2014, now Pat. No. 10,165,919.

(51) Int. Cl.
*A47L 9/14* (2006.01)

(52) U.S. Cl.
CPC ..... *A47L 9/1436* (2013.01)

(58) Field of Classification Search
CPC ..... A47L 9/1683; A47L 5/28; A47L 9/1666; A47L 9/1691; A47L 9/127; A47L 9/1463; A47L 9/1436; A47L 9/12; A47L 9/122; A47L 9/125; A47L 9/14; A47L 9/1418
See application file for complete search history.

(56) References Cited

U.S. PATENT DOCUMENTS 3,416,721 A 12/1968 Fesco
4,784,676 A 11/1988 Hale
(Continued)

FOREIGN PATENT DOCUMENTS

DE 20010049 U1 9/2000
DE 202004019344 U1 3/2005
(Continued)

OTHER PUBLICATIONS

European Patent Application No. 19179361.1, Extended European Search Report, dated Sep. 20, 2019.
(Continued)

*Primary Examiner* — Robert J Scruggs
(74) *Attorney, Agent, or Firm* — Marshall, Gerstein & Borun LLP

(57) ABSTRACT

A vacuum cleaner bag assembly is adapted to be removably disposed within a tank of a vacuum cleaner, and the bag assembly includes a panel assembly made from a first material and forming an enclosure having an interior volume, and an aperture extends through the panel assembly. A shield member may be disposed within the interior volume and secured to one or more portions of the panel assembly, and the shield member may comprise a second material that is different than the first material. The shield member is adapted to protect a portion of the panel assembly when the vacuum cleaner bag assembly is disposed within the tank.

19 Claims, 10 Drawing Sheets

(56) References Cited

U.S. PATENT DOCUMENTS

| | | | | |
|---|---|---|---|---|
| 5,735,017 | A * | 4/1998 | Barnes | A47L 7/0028 15/321 |
| 6,171,369 | B1 * | 1/2001 | Schultink | B32B 29/02 95/57 |
| 6,786,947 | B2 | 9/2004 | Mountford | |
| 7,794,516 | B2 | 9/2010 | McAllise et al. | |
| 8,572,789 | B2 * | 11/2013 | Horne | A47L 9/1625 15/1.51 |
| 10,165,919 | B2 * | 1/2019 | Blackwell, Jr. | A47L 9/1436 |
| 2003/0140606 | A1 | 7/2003 | Smithies | |
| 2003/0145566 | A1 | 8/2003 | Parks et al. | |
| 2006/0278087 | A1 | 12/2006 | Sepke et al. | |
| 2008/0099053 | A1 | 5/2008 | Loveless | |
| 2011/0126377 | A1 | 6/2011 | Bosses | |
| 2011/0265283 | A1 | 11/2011 | Duncan | |
| 2015/0342432 | A1 | 12/2015 | Blackwell, Jr. et al. | |

FOREIGN PATENT DOCUMENTS

| | | | |
|---|---|---|---|
| DE | 202006016303 | U1 | 12/2006 |
| DE | 202013003445 | U1 | 4/2013 |
| EP | 0960645 | A2 | 12/1999 |
| WO | WO-00/56421 | A1 | 9/2000 |

OTHER PUBLICATIONS

Chinese Patent Application No. 201580029681.7, First Office Action, dated Sep. 26, 2018.

Chinese Patent Application No. 201580029681.7, Search Report, dated Sep. 17, 2018.

International Report on Patentability and Written Opinion for International Application No. PCT/US2015/010125, dated Dec. 6, 2016.

International Search Report and Written Opinion for Application No. PCT/US2015/010125 dated Jun. 17, 2015.

International Search Report and Written Opinion for, corresponding International Application No. PCT/US2015/010132, dated Jun. 22, 2015.

Partial International Search Report for Application No. PCT/US2015/010125, dated Mar. 13, 2015.

Partial International Search Report, corresponding International Application No. PCT/US2015/010132.

Australian Patent Application No. 2015268876, Examination Report No. 1, dated Mar. 30, 2019.

* cited by examiner

VACUUM BAG

CROSS-REFERENCE TO RELATED APPLICATIONS

Priority is claimed to U.S. patent application Ser. No. 14/295,025, filed on Jun. 3, 2014, the entire contents of which are incorporated herein by reference.

FIELD OF THE DISCLOSURE

This disclosure relates generally to filter bags for use in vacuum cleaners and more particularly to filter bags that may be used in connection with materials that can abrade the filter bag and diminish its filtering ability.

BACKGROUND

A variety of vacuum devices is known in the art and typically includes a holding tank or other receptacle and a suction mechanism, generally comprised of an electric motor and impeller. A hose or other flexible conduit is usually provided having a first end that is generally connected to an inlet fitting on the receptacle and a second end that is adapted to be positioned by a user.

Materials entering the receptacle are generally prevented from entering the suction mechanism or being exhausted from the vacuum cleaner by a filter, for instance, of pleated material in the shape of a cylinder, or cloth in the shape of a disk that surrounds a cage or filter assembly. Materials may also be contained in a filter bag configured so that material suctioned through the hose stays inside the bag. The bag has an inlet, such as an aperture, that engages a first end of the inlet fitting, and a second end of the inlet fitting engages the first end of the hose. When the suction mechanism is operated, material is drawn through the first end of the hose to the second end of the hose and is deposited within the bag disposed in the receptacle. While a filter around the cage or filter assembly may adequately protect the motor and impeller from dust and debris, and prevent most particulate material from being exhausted from the vacuum cleaner with the exhausted air, bags are often preferable, instead of or in addition to those filters. Bags contain the debris, so that emptying the receptacle of debris creates less dust or other mess when a bag is used. Certain high efficiency filters can be fairly expensive, so bags are also desirable as a way to limit the dust and debris engaged by the filter, thereby extending its useful life.

Known bags may be made from a paper material. Such bags are inexpensive and act as an effective filter to trap dirt and other solid debris within the bag. However, such bags are relatively weak, and may abrade easily, lessening their filtering efficiency. These bags may also rupture when lifted, such as when removing it from the holding tank. Paper filters may be lined with another material, such as a non-woven, high-efficiency filtration medium, in order to increase the filtering efficiency, which can similarly be degraded by abrasive materials. Bags made of other materials, such as woven or cloth bags, may be stronger than paper bags, but such cloth bags are expensive and therefore are not usually suitable for disposable applications and may have undesirable filtering characteristics. Accordingly, there exists a need for a bag that is inexpensive, has good filtering characteristics, and is strong, particularly, when used for abrasive materials.

BRIEF SUMMARY OF THE DISCLOSURE

In one embodiment, a vacuum cleaner bag assembly is adapted to be removably disposed within a tank assembly of a vacuum cleaner having a hose assembly and a filter assembly extending at least partially into the tank assembly. The vacuum cleaner bag assembly includes a panel assembly forming an enclosure having an interior volume. An aperture extends through the panel assembly, and the aperture is adapted to receive debris exiting an outlet end of a hose assembly such that the debris is retained within the interior volume. The panel assembly comprises a first panel and a second panel, with each of the first panel and the second panel including an outer sheet and a liner sheet. Each of the outer sheets comprises a first outer material and each of the liner sheets comprises a first liner material. The vacuum cleaner bag assembly further includes a shield member disposed within the interior volume and secured to one or more portions of the panel assembly. The shield member comprises a second material that is different than each of the first outer material and the first liner material. The shield member extends vertically from a first point at or adjacent to a top portion of the panel assembly to a second point vertically disposed between a bottom portion of the aperture and a bottom portion of the panel assembly. The shield member is disposed opposite the aperture in the panel assembly when the vacuum cleaner bag assembly is disposed within the tank such that the shield member protects a corresponding portion of the panel assembly from being impacted by debris passing through the aperture and into the interior volume.

In another embodiment of the disclosure, a vacuum cleaner bag assembly may be adapted to be removably disposed within a tank of a vacuum cleaner, and the vacuum cleaner bag assembly includes a first outer sheet assembly comprising a first outer material and a first liner material, and each of the first outer material and first liner material is a non-woven material that is one of a wood pulp and/or polyester material. The vacuum cleaner bag assembly also includes a second outer sheet assembly comprising the first outer material and the first liner material, and an aperture is disposed through the first outer sheet assembly, the aperture being adapted to receive debris exiting an outlet end of a hose assembly coupled to the vacuum cleaner such that the debris is retained within an interior volume at least partially defined by the first outer sheet assembly and second outer sheet assembly.

In a further embodiment, a vacuum cleaner assembly includes a tank having an interior portion, a suction assembly coupled to a top portion of the tank, a filter assembly coupled to the suction assembly and extending into the interior portion of the tank, and a hose assembly coupled to the tank. A vacuum cleaner bag assembly is removably disposed within the interior portion of the tank, and the vacuum cleaner bag assembly includes a panel assembly forming an enclosure having an interior volume. An aperture extends through the panel assembly, and the aperture is adapted to receive debris exiting an outlet end of a hose assembly such that the debris is retained within the interior volume. The panel assembly comprises a first panel and a second panel, with each of the first panel and the second panel including an outer sheet and a liner sheet. Each of the outer sheets comprises a first outer material and each of the liner sheets comprises a first liner material. The vacuum cleaner bag assembly further includes a shield member disposed within the interior volume and secured to one or more portions of the panel assembly. The shield member comprises a second material that is different than each of the first outer material and the first liner material. The shield member extends vertically from a first point at or adjacent to a top portion of the panel assembly to a second point vertically disposed between a bottom portion of the aperture and a bottom portion of the panel assembly. The shield member is disposed opposite the aperture in the panel assembly when the vacuum cleaner bag assembly is disposed within the tank such that the shield member protects a corresponding portion of the panel assembly from being impacted by debris passing through the aperture and into the interior volume.

DETAILED DESCRIPTION

Figure 1A:
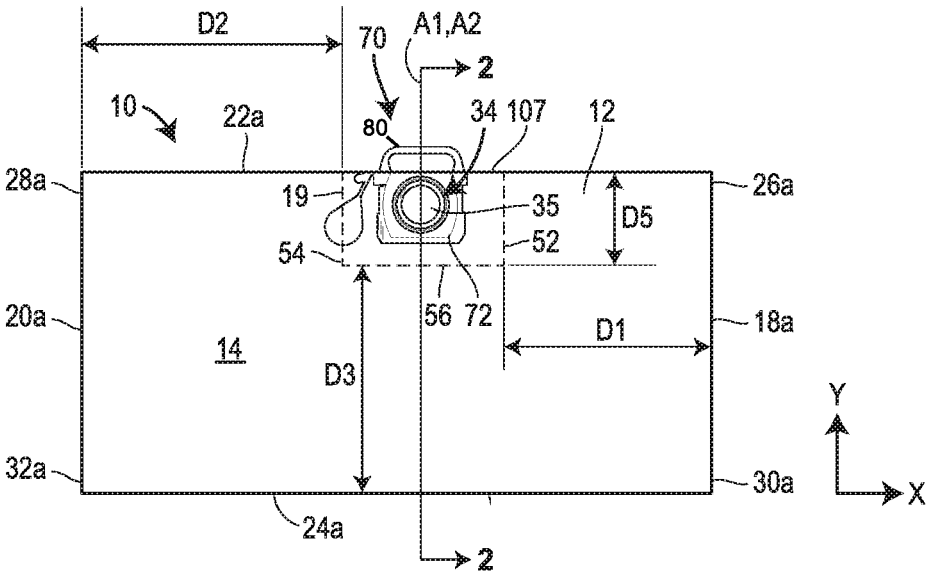
FIG. 1A is a front view of an embodiment of a vacuum cleaner bag assembly.
Figure 2:
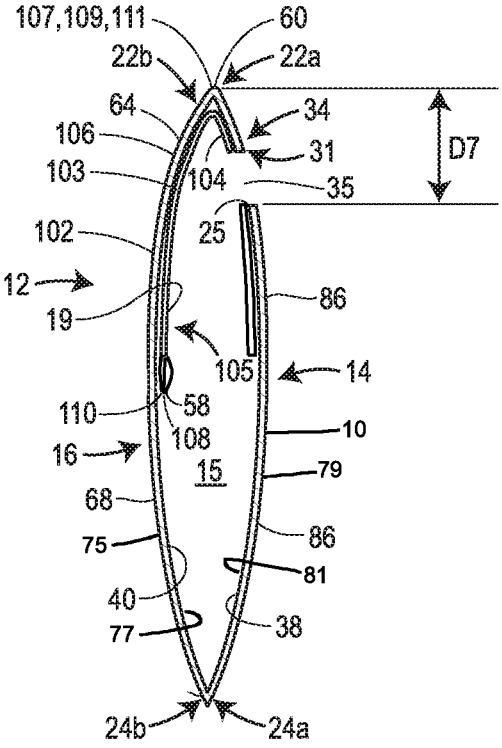
FIG. 2 is a sectional view taken along section line 2-2 of FIG. 1A.
Figure 3:
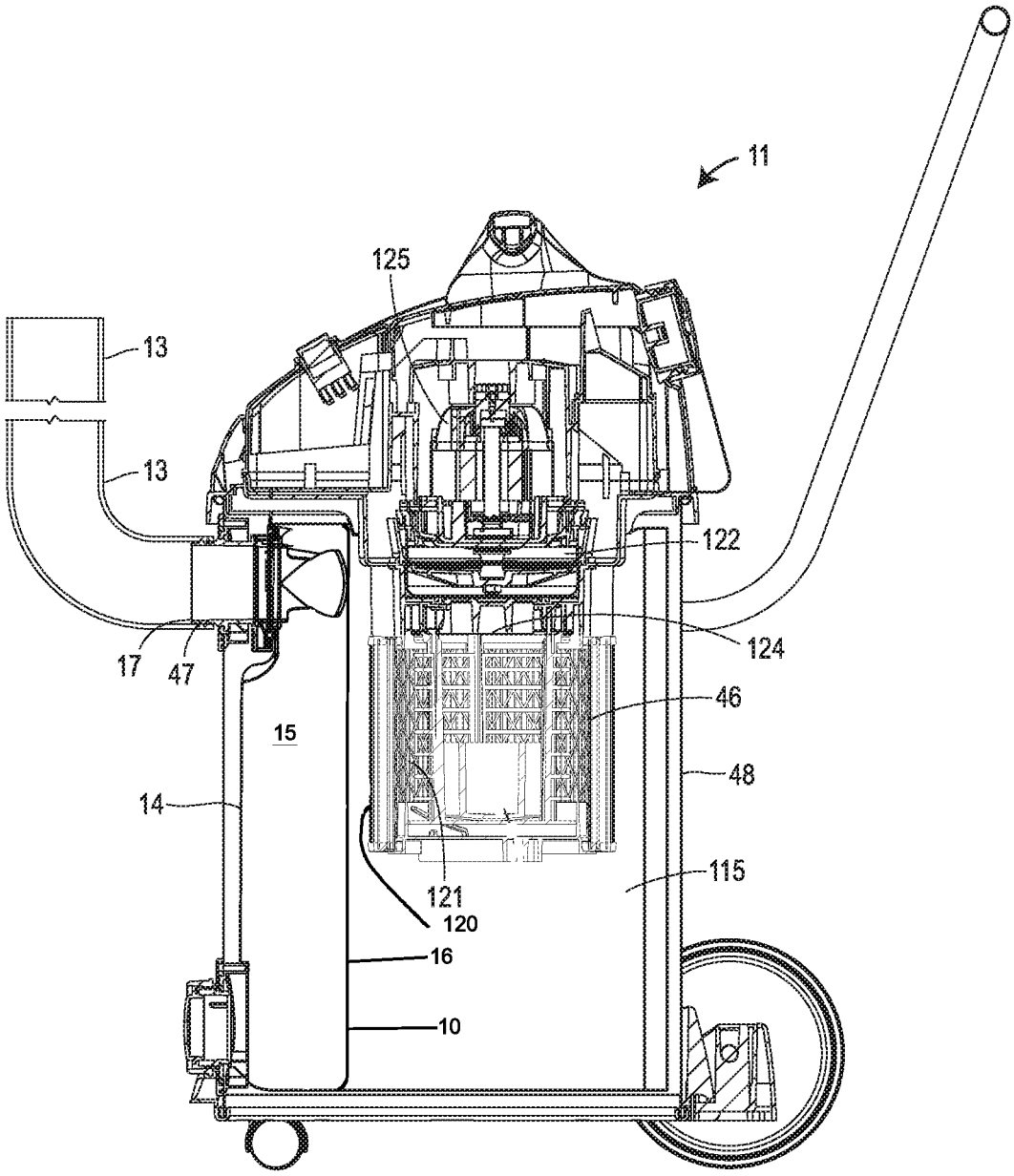
FIG. 3 is a partial sectional side view of a vacuum cleaner including the vacuum cleaner bag assembly of FIG. 1A, with the vacuum cleaner bag assembly in a deflated state.
Figure 4:
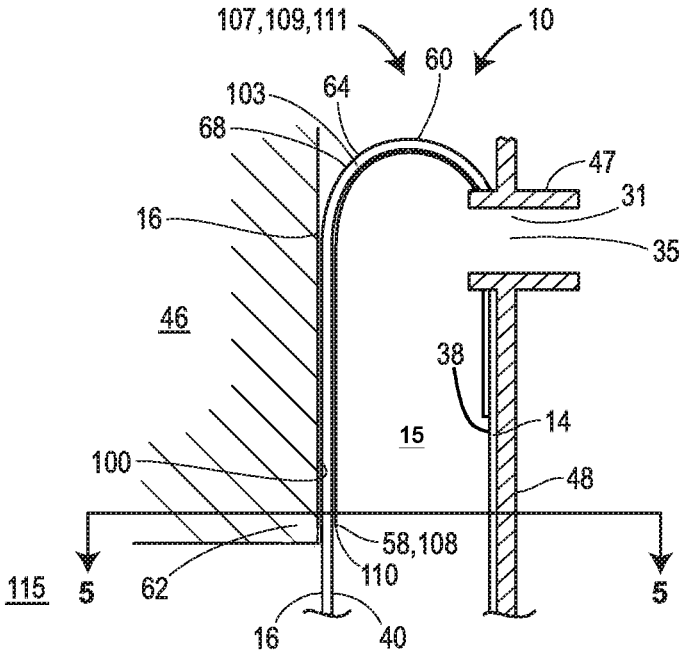
FIG. 4 is a partial sectional side sectional view of a vacuum cleaner taken along section line 2-2 of the vacuum cleaner bag assembly of FIG. 1A.
Figure 11A:
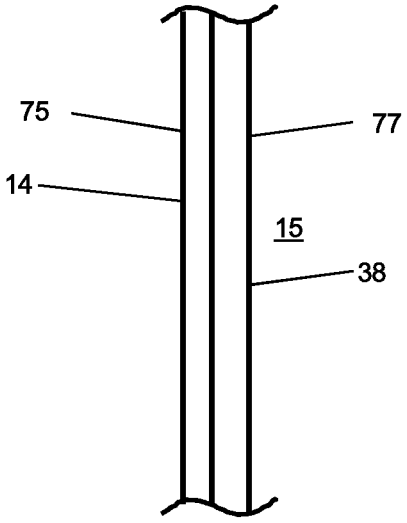
FIG. 11A is a cross-sectional view of a portion of the first panel of an embodiment of the panel assembly.
Figure 11B:
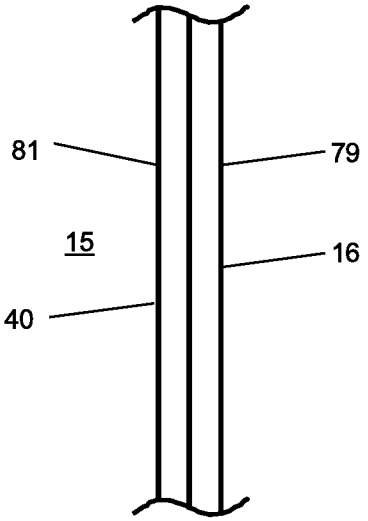
FIG. 11B is a cross-sectional view of a portion of the second panel of an embodiment of the panel assembly.

As illustrated in FIG. 3, a vacuum cleaner bag assembly 10 is adapted to be removably disposed within a tank 48 of a vacuum cleaner 11 having a hose assembly 13 and a filter assembly 46 extending at least partially into the tank 48. While the vacuum cleaner 11 is depicted is a tank-type vacuum cleaner, it should be understood that other types of vacuum cleaners can be used in accordance with the claimed invention, including canister vacuum cleaners, upright vacuum cleaners, etc. As illustrated in FIGS. 1A and 2, the vacuum cleaner bag assembly 10 includes a panel assembly 12 forming an enclosure having an interior volume 15 (illustrated in FIG. 2), and the panel assembly 12 may comprise at least a first panel 14 and a second panel 16, with the first panel 14 being coupled to the second panel 16. The vacuum cleaner bag assembly 10 may further include an inlet portion 34 disposed on the panel assembly 12, and the inlet portion 34 may include an aperture 35 adapted to receive debris exiting an outlet end 17 of the hose assembly 13 such that the debris is retained within the interior volume 15, as illustrated in FIGS. 3 and 4. In one version of the disclosure, the first panel 14 includes an outer sheet 75 and a liner sheet 77 (as illustrated in FIG. 11A), and the second panel 16 includes an outer sheet 79 and a liner sheet 81. Each of the outer sheets 75, 79 may comprise a first outer material and each of the liner sheets 77, 81 may comprise a first liner material (as illustrated in FIG. 11B). Each of the first outer material and the first liner material may be a non-woven material, such as a wood pulp polyester blend and a high filter efficiency material, respectively.

Figure 7A:
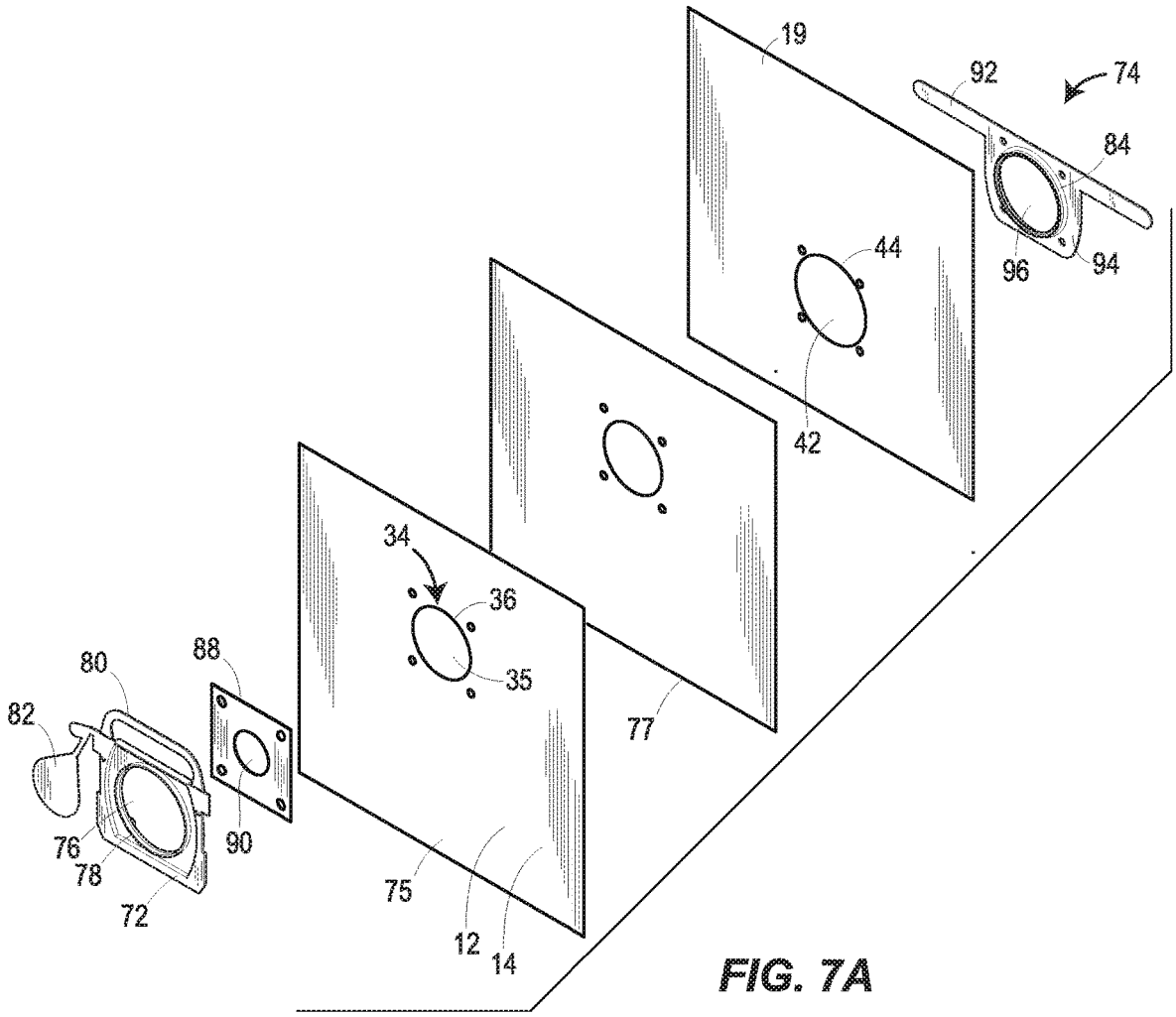
FIG. 7A is an exploded perspective view of inlet assembly of the vacuum cleaner bag assembly of FIG. 1A.

As illustrated in FIGS. 2, 4, and 7A, the vacuum cleaner bag assembly 10 additionally includes a shield member 19 disposed within the interior volume 15 and secured or coupled to one or more portions of the panel assembly 12. The shield member 19 comprises a second material that is different than the first outer material and the first liner material. In some versions, the second material can be a non-porous and non-absorbent flexible material that resists abrasion. For example, the shield member 19 may comprise a plastic material, such as a thermoplastic polymer, and, more specifically, may be polypropylene. Alternative and/or additional materials and combinations of materials could also be used. Referring to FIGS. 2 and 4, the shield member 19 may extend vertically from a first point 109 at or adjacent to a top portion of the panel assembly 12 to a second point 110 vertically disposed between a bottom portion 25 of the aperture 35 and a bottom portion of the panel assembly 12. As illustrated in FIG. 4, the shield member 19 may be adapted to be disposed adjacent to an outer cylindrical wall portion 100 of the filter assembly 46 when the vacuum cleaner bag assembly 10 is disposed within the tank 48, and the shield member 19 may be adapted to protect a portion of the panel assembly 12 disposed between the shield member 19 and the filter assembly 46 when the vacuum cleaner bag assembly 10 is disposed within the tank 48. As illustrated in FIG. 3, the filter assembly 46 is shown with a cartridge type filter 120 mounted on a cage 121 so that air drawn by an impeller 122 passes thought the cartridge type filter 120. The vacuum cleaner 11 may be operated without the cartridge type filter 120 on the filter assembly 46 in certain situations, such as in vacuums that are not configured to have any additional filter or with a different type of filter. Referring to FIG. 2, debris entering the interior volume 15 of the panel assembly 12 via the aperture 35 impacts the shield member 19, and the shield member 19 thereby prevents debris from directly contacting a corresponding portion 102 of the panel assembly 12, which could weaken, tear, or otherwise damage the panel assembly 12.

Figure 1B:
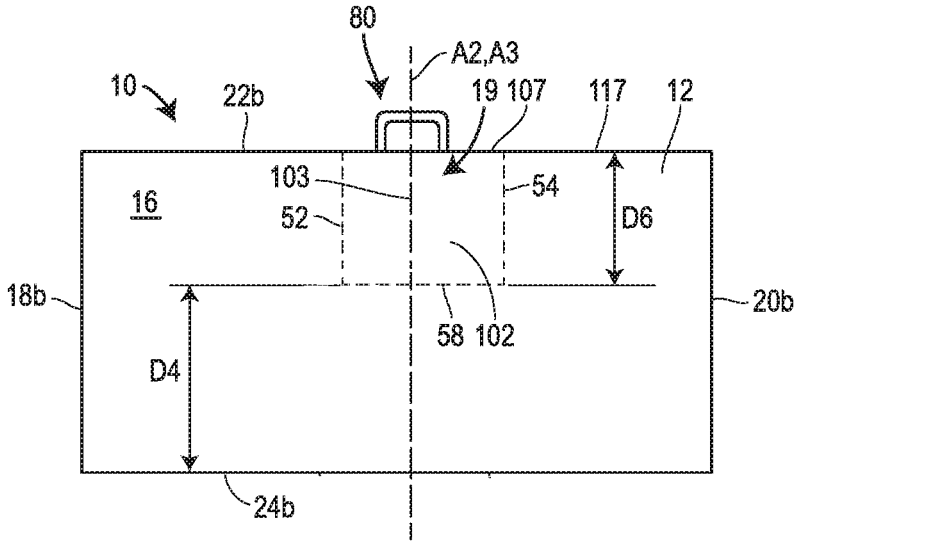
FIG. 1B is a rear view of the embodiment of the vacuum cleaner bag assembly of FIG. 1A.

Turning to the vacuum cleaner bag assembly 10 in more detail, the panel assembly 12 may include a plurality of panels, such as the first panel 14 and the second panel 16, as illustrated in FIGS. 1A, 1B, and 2. The first panel 14 may include a first lateral edge 18*a* and a second lateral edge 20*a* offset from the first lateral edge 18*a*, and each of the first lateral edge 18*a* and the second lateral edge 20*a* may extend in a vertical direction (i.e., a direction parallel to the Y-axis of the reference coordinate system of FIG. 1A) or a substantially vertical direction. Each of the first lateral edge 18*a* and the second lateral edge 20*a* may have any suitable shape or combination of shapes. For example, each of the first lateral edge 18*a* and the second lateral edge 20*a* may be linear and may extend parallel to or substantially parallel to the Y-axis of the reference coordinate system of FIG. 1A.

Still referring to FIG. 1A, the first panel 14 may also include a first transverse edge 22*a* and a second transverse edge 24*a*. The first transverse edge 22*a* may extend between a first end 26*a* of the first lateral edge 18*a* and a first end 28*a* of the second lateral edge 20*a*. The second transverse edge 24*a* may extend between a second end 30*a* of the first lateral edge 18*a* and a second end 32*a* of the second lateral edge 20*a*. The first transverse edge 22*a* and the second transverse edge 24*a* may each extend in a horizontal direction (i.e., a direction parallel to the X-axis and normal to the Y-axis of the reference coordinate system of FIG. 1A) or a substantially horizontal direction, and the first transverse edge 22*a* may be vertically offset from the second transverse edge 24*a*. Each of the first transverse edge 22*a* and the second transverse edge 24*a* may have any suitable shape or combination of shapes. For example, each of the first transverse edge 22*a* and the second transverse edge 24*a* may be linear and may extend parallel to or substantially parallel to the X-axis of the reference coordinate system of FIG. 1A.

The first panel 14 may comprise a single sheet of material or two or more sheets of material. For example, as illustrated in FIG. 11A, the first panel 14 may include both an outer sheet 75 and a liner sheet 77 that cooperate to form the first panel 14. Each of the outer sheet 75 and the liner sheet 77 may have the same shape and/or dimensions as the first panel 14. All or a portion of the outer sheet 75 may be secured to the liner sheet 77. For example, the outer sheet 75 may be secured to the liner sheet 77 at one or more of the first lateral edge 18*a*, the second lateral edge 20*a*, first transverse edge 22*a*, and/or the second transverse edge 24*a*.

Referring now to FIG. 1B, the second panel 16 of the panel assembly 12 may include a first lateral edge 18*b* and a second lateral edge 20*b* offset from the first lateral edge 18*a*, and the first lateral edge 18*b* and the second lateral edge 20*b* may align with the first lateral edge 18*a* and the second lateral edge 20*a*, respectively, of the first panel 14 when viewed along an axis normal to the X-Y plane of the of the reference coordinate system of FIG. 1A. However, the first lateral edge 18*b* and a second lateral edge 20*b* may have any suitable shape, combination of shapes, and/or orientations. In addition, the second panel 16 may include a first transverse edge 22*b* and a second transverse edge 24*b*, and each of the first transverse edge 22*b* and the second transverse edge 24*b* may align with the first transverse edge 22*a* and the second transverse edge 24*a*, respectively, of the first panel 14 when viewed along an axis normal to the X-Y plane of the of the reference coordinate system of FIG. 1A. However, the first transverse edge 22*b* and the second transverse edge 24*b* may have any suitable shape, combination of shapes, and/or orientations.

The second panel 16 may comprise a single sheet of material or two or more sheets of material. For example, as illustrated in FIG. 11B, the second panel 16 may include both an outer sheet 79 and a liner sheet 81 that cooperate to form the second panel 16. Each of the outer sheet 79 and the liner sheet 81 may have the same shape and/or dimensions as the second panel 16. All or a portion of the outer sheet 79 may be secured to the liner sheet 81. For example, the outer sheet 79 may be secured to the liner sheet 81 at one or more of the first lateral edge 18*b*, the second lateral edge 20*b*, first transverse edge 22*b*, and/or the second transverse edge 24*b*.

One or more portions of the first panel 14 may be secured to one or more portions of the second panel 16 to form an enclosure (e.g., a sealed enclosure) having an interior volume 15. The interior volume 15 may be at least partially defined by an inner surface 38 of the first panel 14 and an inner surface 40 of the second panel 16, as illustrated in FIG. 4. If the first panel 14 and second panel 16 each comprise two sheets of material (as illustrated in FIGS. 11A and 11B), the inner surface 38 of the first panel 14 may correspond to an inner surface of the liner sheet 77 and the inner surface 40 of the second panel 16 may correspond to an inner surface of the liner sheet 81. So configured, the liner sheet 77 of the first panel 14 may be disposed between the outer sheet 75 of the first panel 14 and the interior volume 15, and the liner sheet 81 of the second panel 16 may be disposed between the outer sheet 79 of the second panel 16 and the interior volume 15.

In some versions, one or more additional panels cooperating to form the panel assembly 12 may also form portions of the interior volume 15. For example, a further panel, such as a third panel (not shown), may extend between the first panel 14 and second panel 16 at any suitable location. In some embodiments, e.g., the embodiment of FIGS. 1A and 1B, the panel assembly 12 may be formed from or comprise a single piece or sheet (or a single layered combination or sandwich of materials, as illustrated in FIGS. 11A and 11B) of material that is folded along an axis that is aligned with or adjacent to the first transverse edge 22*a* of the first panel 12 and the first transverse edge 22*b* of the second panel 16. So configured, an adhesive may be applied to (or may be disposed on) the first panel 14 along or adjacent to the first lateral edge 18*a* and/or the second panel 16 along or adjacent to the first lateral edge 18*b*. An adhesive may also be applied to (or may be disposed on) the first panel 14 along or adjacent to the second lateral edge 20*a* and/or the second panel 16 along or adjacent to the second lateral edge 20*b*. Additionally, an adhesive may also be applied to (or may be disposed on) the first panel 14 along or adjacent to the second transverse edge 24*a* and/or the second panel 16 along or adjacent to the second transverse edge 24*b*. In other embodiments, the panel assembly 12 may be formed from two (or more) sheets or materials that comprise a layered combination or stack of materials, as illustrated in FIGS. 11A and 11B, and the layered combination or stack may function as the single sheet previously described.

In still further embodiments (not shown), the panel assembly 12 may be formed from or comprise two or more independent or separate pieces or sheets (or assemblies of sheets) of materials that may be secured together to form a sealed enclosure. For example, the first panel 14 may include the outer sheet 75 and the liner sheet 77, and the second panel 16 may include the outer sheet 79 and the liner sheet 81, and each of the liner sheets 77, 81 and the outer sheets 75, 79 may be separate sheets that do not share an integrally formed edge with another of the liner sheets 77, 81 and/or outer sheets 75, 79. In such an embodiment, an adhesive may be applied to (or may be disposed on) the first panel 14 (e.g., either one or both of the liner sheet 77 or the outer sheet 75) along or adjacent to the first transverse edge 22*a* and/or the second panel 16 (e.g., either one or both of the liner sheet 81 or the outer sheet 81) along or adjacent to the first transverse edge 22*b*. Any suitable adhesive or combination of adhesives may be used to secure the first panel 14 to the second panel 16. Instead of an adhesive, the first panel 14 may be secured to the second panel 16 in any suitable manner, such as by stitching, ultrasonic welding, etc. Both the first sheet (of the first panel 14, if only a single sheet is used) and the second sheet (of the second panel 16, if only a single sheet is used) may have identical material properties or may have one or more different material properties.

In the embodiment of FIGS. 1A and 1B, the distance between the first lateral edge 18*a* and the second lateral edge 20*a* may have any suitable value, such as 38.00", or 42.00". In addition, the distance between the first transverse edge 22*a* and the second transverse edge 24*a* may have any suitable value, such as 15.5", or 21.00". As one skilled in the art will appreciate, the appropriate size of the bag will be dependent on the size of the tank.

In other embodiments, an additional panel, such as a third panel (not shown) may be secured or coupled to the first panel 14 and/or the second panel. For example, the third panel may extend between the first transverse edge 22*a* of the first panel 12 and the first transverse edge 22*b* of the second panel 16, and the third panel may be coupled to portions of both the first panel 14 and the second panel 16 in any suitable manner. In addition, it may be desirable in some situation to have pleats or similar configurations in the panels to all for optimum use of the space within the tank and capacity of the vacuum bag.

As illustrated in FIG. 1A and as discussed above, the vacuum cleaner bag assembly 10 may also include the inlet portion 34 formed in the panel assembly 12. The inlet portion 34 may be adapted to engage a first end of a hose fitting 47 (illustrated in FIG. 3) that is coupled to the tank 48, and a second end of the hose fitting 47 may be adapted to engage an end 17 of the hose assembly 13. Referring again to FIG. 1A, the inlet portion 34 may be formed in one or both of the first panel 14 or the second panel 16. In some embodiments, the inlet portion 34 is formed on the first panel 14. The inlet portion 34 may have any suitable shape or combination of shapes. For example, the inlet portion 34 may be an aperture 35 defined by a perimeter edge 36 that may have any suitable shape, such as that of a circle, oval, or a polygon, for example. For example, the perimeter edge may be circular and may have a diameter in a range of about 1 inch to about 4 inches. The inlet portion 34 may include a plurality of perforations and/or one or more scored edges or the like to create the aperture 35 defined by the perimeter edge 36. Referring to FIG. 3, the aperture 35 may be adapted to receive, be disposed adjacent to, or otherwise engage all or a portion of the first end of the hose fitting 47 such that debris exiting the outlet end 17 of the hose assembly 13 is deposited in the interior volume 15 of the panel assembly 12.

The panel assembly 12 (i.e., the first panel 14 and/or the second panel 16 of, for example, the embodiment illustrated in FIGS. 1A and 1B) may comprise or include a material that is porous and has an acceptable filter efficiency rating. For example, the panel assembly 12 (i.e., the first panel 14 and/or the second panel 16) may be made from or comprise a non-woven material, such as a wood pulp or polyester, or a wood pulp/polyester blend. In the wood pulp/polyester blend, the material may have a range of between about 25% wood pulp and about 57% wood pulp, with the remainder being polyester or other non-water soluble material. In particular, the wood pulp and polyester blend may be between about 55% wood pulp and about 45% wood pulp. More specifically, the material may be about 55% wood pulp/about 45% STD polyester (DuPont® material no. 8801), about 45% wood pulp/about 55% STD polyester (DuPont® material no. 8836), about 54% wood pulp/about 46% STD polyester (DuPont® material no. 8838), about 56% wood pulp/about 44% STD polyester (DuPont® material no. 8861), about 51% wood pulp/about 49% STD polyester (DuPont® material no. 8864), about 50% wood pulp/about 50% STD polyester (DuPont® material no. 8868), 52% wood pulp/48% STD polyester (DuPont® material no. 8880), about 25% wood pulp/about 75% STD polyester (DuPont® material no. 9923), about 57% wood pulp/about 43% STD polyester (DuPont® material no. 9928), and about 47% wood pulp/about 53% STD polyester (DuPont® material no. 9995), for example.

The wood pulp and polyester may be arranged in any suitable manner. For example, the outer sheet 75 of the first panel 14 and the outer sheet 79 of the second panel 16 may comprise a first outer material and the liner sheet 77 of the first panel 14 and the liner sheet 81 of the second panel 16 may comprise a first liner material. The first outer material may be any suitable material. For example, the first outer material may be wood pulp (or a first wood pulp/polyester blend). The wood pulp and polyester may be blended, interwoven, or otherwise mixed to form all or a portion of the material comprising the panel assembly 12. While wood pulp and polyester are described as being the primary components of the material making up the panel assembly 12, these are examples and other embodiments or versions could have different and/or additional constituent materials consisting of non-woven, high efficiency filter media.

The first liner material may be any suitable material. For example, the first liner material may be a non-woven, high filter efficiency material, such as polypropylene. More specifically, the first liner material may be an electrostatically charged meltblown. The basis weight of the first liner material may be about 30 g/m$^2$, about 34 g/m$^2$ (±about 4 g/m$^2$), or about 40 g/m$^2$ (±about 5 g/m$^2$). The thickness of the first liner material may be about 10 mil (±about 3 mil), about 12 mil (±about 3 mil), or about 15.7 mil. The first liner material may have a target tensile strength of about 3 lb./in. or about 2.2 lb./in. and a minimum tensile strength of about 2 lb./in. or about 1.8 lb./in. The first liner material may have a target elongation of about 35% or about 40% and a minimum elongation of about 15%. For example, the first liner material may be VILEDON® Product No. V638476/01/10 manufactured by Freudenberg Viesstoffe KG, Product No. PE13034 manufactured by Hollingsworth & Vose Company, or Product No. PE13040V manufactured by Hollingsworth & Vose Company.

The non-woven first outer material in one version of the disclosure may have an air permeability (at 0.5" of water) between about 38 CFM/ft$^2$ and about 153 CFM/ft$^2$. More specifically, the non-woven material may have an air permeability (at 0.5" of water) about 102 CFM/ft$^2$, about 38 CFM/ft$^2$, about 68 CFM/ft$^2$, about 132 CFM/ft$^2$, about 139 CFM/ft$^2$, about 153 CFM/ft$^2$, about 46 CFM/ft$^2$, about 112 CFM/ft$^2$, about 52.5 CFM/ft$^2$, or about 117 CFM/ft$^2$. The non-woven material may have a water column pressure drop (at 50 feet per minute between about 0.15" of water and about 0.68" of water. More specifically, the non-woven material may have a water column pressure drop (at 50 feet per minute) of about 0.35" of water, of about 0.19" of water, of about 0.68" of water, of about 0.48" of water, of about 0.17" of water, of about 0.47" of water, or of about 0.15" of water. The non-woven material may have a pressure drop after 1000 grams of wood flour has been introduced of between about 3.7% and 13%. More specifically, the non-woven material may have a pressure drop after 1000 grams of wood flour has been introduced of about 13%, about 6.3%, about 9.5%, about 6.8%, about 10.4%, and about 3.7%.

In some versions, the non-woven materials may have a grain characterized by a plurality of parallel or generally parallel and co-extensive material filaments or material fibers, for example. The grain of the non-woven material may have any suitable orientation. For example, the grain of the non-woven material may be parallel to or substantially parallel to the Y-axis of the reference coordinate system of FIG. 1A to maximize the strength of the material as it is lifted vertically out of the tank 48, such as by the handle 80 (see FIG. 1A), for subsequent disposal. The dry strength (with the grain) of the non-woven material may be between about 11.6 lbs. and over about 20.0 lbs. The "dry strength" is defined herein as a force required to tear a 1.0" square sample of dry material. To perform the test, the 1" square sample of dry material is secured on each opposite end by an aluminum securement block, and the securement blocks are moved in opposite directions by use of weights until the material fails, at which time the maximum force (the dry strength value) is recorded. More specifically, the dry strength (with the grain) of the non-woven material may be about 16.0 lbs., about 13.2 lbs., about 11.6 lbs., about 18.6 lbs., about 14.0 lbs., about 15.5 lbs., about 12.5 lbs., about 20.0 lbs., or about 16.4 lbs. The dry strength (against the grain) of the non-woven material may be between about 3.3 lbs. and about 8.2 lbs. More specifically, the dry strength (against the grain) of the non-woven material may be about 6.2 lbs., about 3.3 lbs., about 5.1 lbs., about 4.8 lbs., about 5 lbs., about 7.6 lbs., about 4.8 lbs., about 8.2 lbs., about 8.0 lbs., or about 5.8 lbs.

As discussed above and as illustrated in FIGS. 1A, 1B, 2, 4, 5, and 7A, the vacuum cleaner bag assembly 10 additionally includes the shield member 19 disposed (or at least partially disposed) within the interior volume 15 of the panel assembly 12. The shield member 19 may provide structural support and/or protection to one or more portions (e.g., interior portions) of the panel assembly 12. For example, as illustrated in FIG. 2, the shield member 19 may provide structural support and/or protection to the panel assembly 12 at desired areas, such as a portion 103 of the panel assembly 12 that is adjacent to and/or opposite the opening portion 34 and/or the portion 102 of the panel assembly 12 that is adjacent to or in contact with the filter assembly 46 of the vacuum cleaner 11 when the vacuum cleaner bag assembly 10 is disposed within the tank 48 of the vacuum cleaner 11. So positioned, the shield member 19 may also protect the portion 102 of the panel assembly 12 that is covered by the shield member 19 from the impact of debris entering the opening portion 34.

The shield member 19 (see, for example, FIG. 8) may be made from or comprise a flexible material (or a combination of flexible materials) that may be abrasion-resistant and/or non-porous and/or non-absorbent (e.g., a material that does not absorb any—or a significant—amount of fluid or allow any—or a significant—amount of fluid or particles to pass through the material), and the flexible material may not comprise wood pulp. The flexible material(s) may have a bending stiffness that may be greater than the bending stiffness of the material(s) comprising the panel assembly 12 (e.g., the first panel 14 and the second panel 16). The flexible material(s) may have a hardness that may be greater than the hardness of the material(s) comprising the panel assembly 12 (e.g., the first panel 14 and the second panel 16). In some embodiments (not shown), the shield member 19 or portions of the shield member 19 may alternatively be rigid and shaped to conform to a desired shape, such as shaped to conform with a portion of the filter assembly 46. The material(s) may also have relatively high impact strength to absorb the force of debris entering the opening portion 34 and contacting the shield member 19 when the shield member 19 is disposed adjacent to the filter assembly 46. For example, the shield member 19 may comprise a plastic material, such as a thermoplastic polymer, and, more specifically, may be polypropylene.

Figure 5:
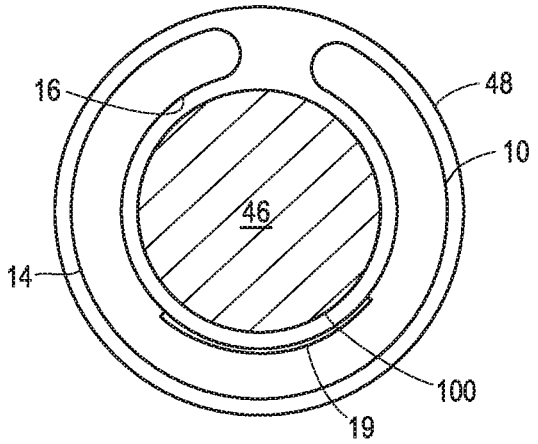
FIG. 5 is a sectional view taken along section line 5-5 of FIG. 4.

As illustrated in FIGS. 2, 4, and 5, the shield member 19 may be disposed within the interior volume 15 of the panel assembly 12. That is, the shield member 19 may be disposed or at least partially disposed between a first interior portion of the panel assembly 12 and a second interior portion of the panel assembly. More specifically, and as illustrated in FIGS. 2 and 4, the shield member 19 may be in contact with or adjacent to at least one of a portion 104 of the inner surface 38 of the first panel 14 and a portion 105 of the inner surface 40 of the second panel 16, and the portion 105 of the inner surface 40 of the second panel 16 may be adjacent to and/or oppositely aligned with the opening portion 34 of the first panel 14.

Figure 8:
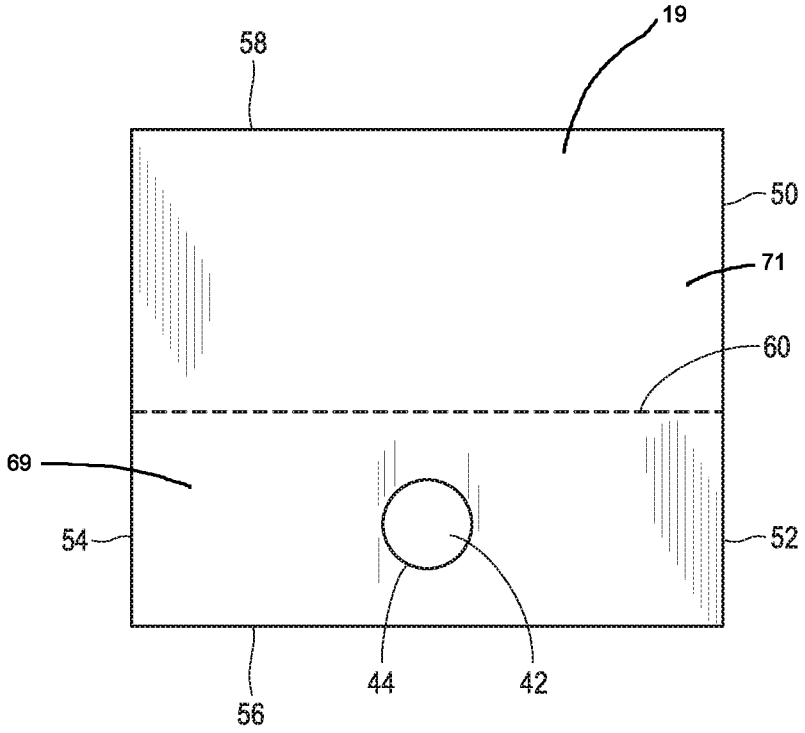
FIG. 8 is a plan view of the shield member prior to insertion in the panel assembly.

The shield member 19 (see, e.g., FIG. 8) may have any suitable shape to provide structural support and/or protection to desired portions of the panel assembly 12. In particular, in its unbiased or unstressed condition, the shield member 19 may be planar or substantially planar and may have a perimeter edge 50, as illustrated in FIG. 8 (which shows the shield member 19 in a planar orientation prior to insertion into the interior portion 15 of the panel assembly 12). The perimeter edge 50 may have any shape or combination of shapes to provide structural support and/or protection to desired portions of the panel assembly 12. The perimeter edge 50 may have one or more linear and/or rounded segments such that the perimeter edge 50 may have a circular, oval, or polygonal shape. For example, the perimeter edge 50 may have the shape of a rectangle, with a first lateral edge 52 extending parallel to a second lateral edge 54. A first transverse edge 56 may extend between a first end of each of the first lateral edge 52 and the second lateral edge 54 and the first transverse edge 56 may be normal to each of the first lateral edge 52 and the second lateral edge 54. A second transverse edge 58 may extend between a second end of each of the first lateral edge 52 and the second lateral edge 54 and the second transverse edge 58 may be normal to each of the first lateral edge 52 and the second lateral edge 54 and parallel to the first transverse edge 56. The shield member 19 may be divided into a first portion 69 (between the transverse axis 60 and the first transverse edge 56) and a second portion 71 (between the transverse axis 60 and the second transverse edge 58).

Figure 9:
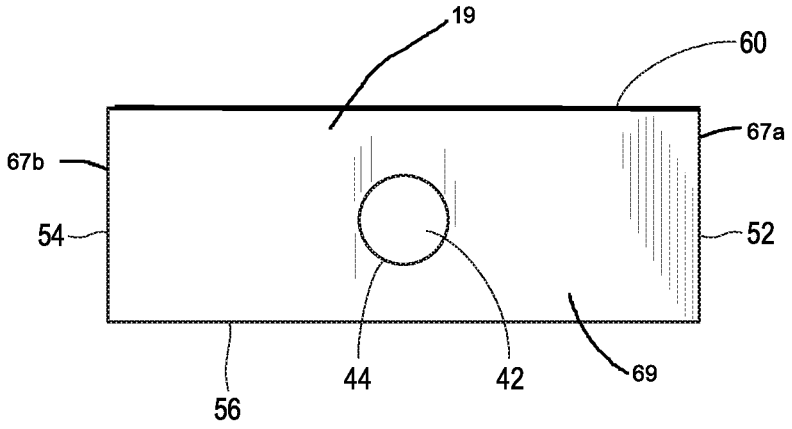
FIG. 9 is a front view of the shield member of FIG. 8 in a folded configuration.
Figure 10:
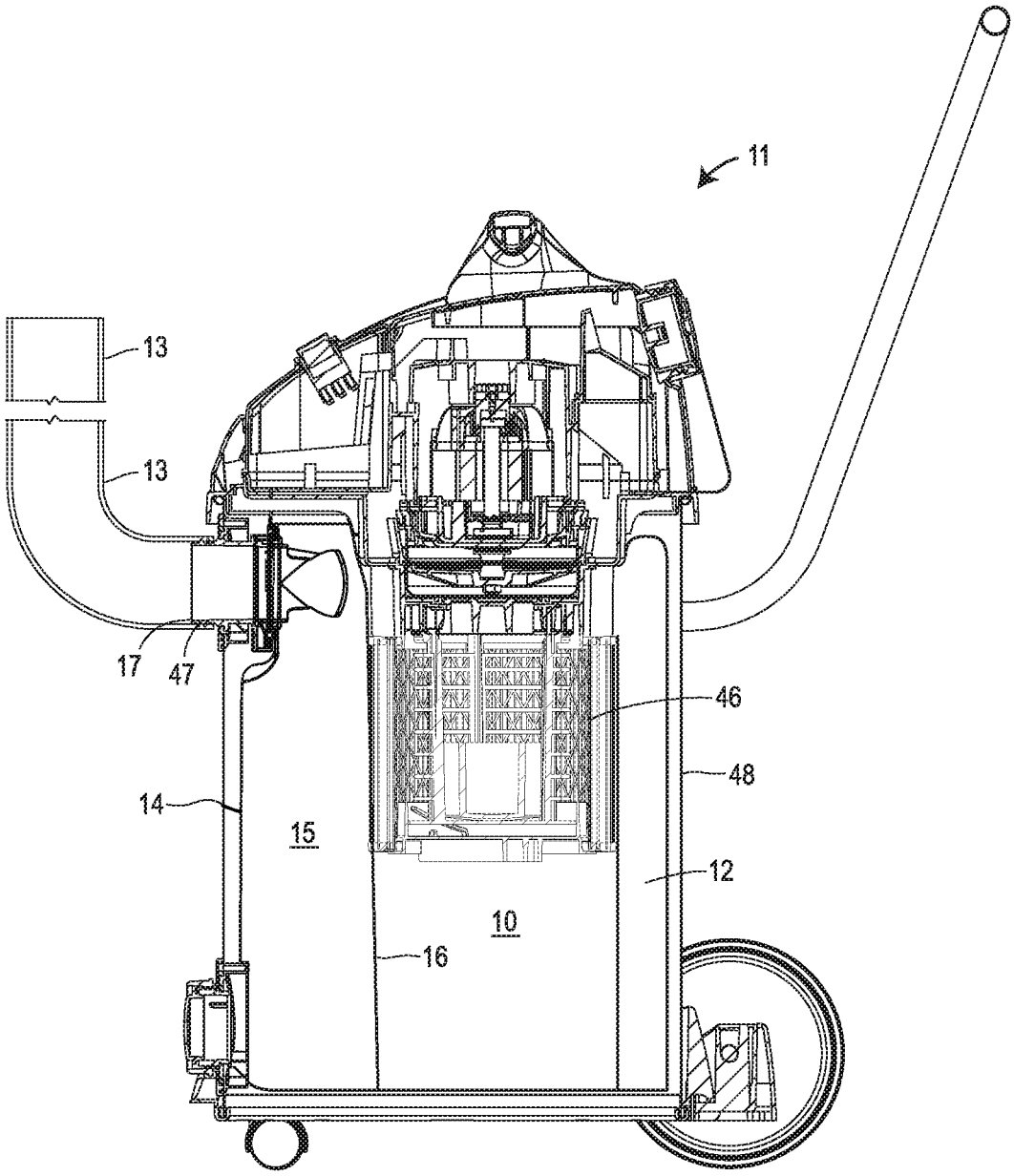
FIG. 10 is a partial sectional side view of a vacuum cleaner including the vacuum cleaner bag assembly of FIG. 1A, with the vacuum cleaner bag assembly in an inflated state.

When disposed within the interior volume 15 of the panel assembly 12, the shield member 19 may be biased, stressed, folded, bent, and/or rotated along or about a transverse axis 60 (illustrated in FIGS. 8 and 9) that may be offset from the first and second transverse edges 56, 58 and parallel to one or both of the first and second transverse edges 56, 58. In some embodiments, the transverse axis 60 may be equidistant from the first and second transverse edges 56, 58. So disposed, the transverse axis 60 may be disposed adjacent to the first transverse edge 22*a* of the first panel 14 and/or the first transverse edge 22*b* of the second panel 16, as illustrated in FIG. 2. When folded along the transverse axis 60 (as illustrated in FIG. 9), a first securement feature 67*a* may be formed along or adjacent to the first lateral edge 52 from the transverse axis 60 to the second transverse edge 58 of the first portion 69. One skilled in the art would recognize that the first securement feature 67*a* extends from the first portion 69 to include the second portion 71 such that the first securement feature 67*a* is also formed at or adjacent to the first lateral edge 52 from the transverse axis 60 to the first transverse edge 56 of the second portion 71. In addition, a second securement feature 67*b* may be formed along or adjacent to the second lateral edge 54 from the transverse axis 60 to the second transverse edge 58 of the first portion 69. One skilled in the art would recognize that the second securement feature 67*b* extends from the first portion 69 to include the second portion 71 such that the second securement feature 67*b* is also formed adjacent to the second lateral edge 54 from the transverse axis 60 to the first transverse edge 56 of the second portion 71.

Still referring to FIG. 9, the first and second securement features 67*a*, 67*b* may have any suitable length. For example, the first and second securement features 67*a*, 67*b* may extend from a first point at or adjacent to the transverse axis 60 to a second point at or adjacent to the second transverse edge 58 of the first portion 69. The first and second securement features 67*a*, 67*b* may be continuous or may each be comprised of two or more segments. The first and second securement features 67*a*, 67*b* may have any suitable shape or combination of shapes, and the first and second securement features 67*a*, 67*b* may extend in a linear or substantially linear direction. Each of the first and second securement features 67*a*, 67*b* may be any suitable bonding or securement feature, such as, for example, a heat seal or an adhesive or bonding agent. The first and second securement features 67*a*, 67*b* partially enclose the shield member 19 along its lateral edges when in the folded configuration of FIG. 9. Configured as described, the first and second securement features 67*a*, 67*b* cooperate to contain debris entering the aperture 35 (see FIG. 2) of the first panel 14 and thus prevent or limit abrasion damage from occurring at portions of the first and second sheets 14, 16 that are adjacent to the first and second lateral edge 52, 54. When the first and second securement features 67*a* and 67*b* are used, all debris entering the vacuum cleaner bag assembly 10 will exit along the first transverse edge 56. Depending on the configuration of the vacuum cleaner, such a configuration should direct debris away from the areas of the panel assembly 12 that are closest to the aperture 35. Debris is generally moving fastest as it passes through the aperture, so it is desirable to protect the areas of the bag material closest to the aperture because faster moving debris is more likely to cause damage to the bag material than slower moving debris present further away from the aperture 35.

Positioned as described, and as illustrated in FIG. 2, a first portion 106 of an inside surface 64 may be disposed in contact with or adjacent to the inner surface 40 of the second panel 16 and a second portion 107 of the inside surface 64 may be disposed in contact with or adjacent to the inner surface 38 of the first panel 14. So disposed, the shield member 19 can have a generally inverted U-shaped cross-section or an inverted J-shaped cross-section, as can be seen in FIGS. 2 and 4, respectively, for example. The transverse axis 60 may be disposed at any suitable location to allow for adequate coverage of a desired area of the panel assembly 12 at or adjacent to a suitable or desired portion of the filter assembly 46.

As illustrated in FIG. 1A, when the shield member 19 and the panel assembly 12 are assembled together, the first lateral edge 52 of the shield member 19 may be inwardly disposed a first distance D1 from the first lateral edge 18*a* of the first panel 14 and the second lateral edge 54 of the shield member 19 may be inwardly disposed a second distance D2 from the second lateral edge 20*a* of the first panel 14. The first distance D1 may be equal or substantially equal to the second distance D2. The first transverse edge 56 may be inwardly disposed a third distance D3 from the second transverse edge 24*a* of the first panel 14 and, as illustrated in FIG. 1B, the second transverse edge 58 may be inwardly disposed a fourth distance D4 from the second transverse edge 24*b* of the second panel 16. The third distance D3 may be equal to or greater than the fourth distance D4. In addition, the first transverse edge 56 may be inwardly disposed a fifth distance D5 from the first transverse edge 22*a* of the first panel 14 and, as illustrated in FIG. 1B, the second transverse edge 58 may be inwardly disposed a sixth distance D6 from the first transverse edge 22*b* of the second panel 16. The fifth distance D5 may be equal to or less than the sixth distance D6.

As illustrated in FIG. 2, a bottom portion 25 of the aperture 35 of the first panel 14 may be inwardly (or vertically) disposed a seventh distance D7 from the first transverse edge 22*a* of the first panel 16, and the sixth distance D6 (see FIG. 1B) may be greater than the seventh distance D7. In addition, a bottom portion 108, such as the second transverse edge 58, may be adjacent to or vertically offset from a bottom portion 62 of the filter assembly 46. That is, the bottom portion 108, such as the second transverse edge 58, may be vertically disposed between the bottom portion 62 of the filter assembly 46 and the bottom portion 25 of the aperture 35 of the first panel 14 (when viewed in cross-section along the X-axis of the reference coordinate system of FIG. 1A). In addition, a top portion 111, such as the portion adjacent to the transverse axis 60, may be vertically disposed between a top portion 107 of the panel assembly 12 (such as the first transverse edge 22*b* of the second panel 16) and a top portion 31 of the aperture 35 of the first panel 14. In addition, as illustrated in FIG. 1A, a vertical axis A1 passing through a center of the aperture 35 of the panel assembly 12 may be aligned (when viewed normal to the X-Y reference plane of the reference coordinate system of FIG. 1A) or substantially aligned with a vertical axis A2 passing through a center portion (or adjacent to the center portion) of the shield member 19.

So configured, as illustrated in FIG. 2, the shield member 19 may at least extend vertically from the first point 109 at or adjacent to the top portion 107 of the panel assembly 12 (e.g., the first transverse edge 22*b* of the second panel 16) to the second point 110 vertically disposed between the bottom portion 25 of the aperture 35 through the first panel 14 and a bottom portion of the panel assembly 12 (e.g., the second transverse edge 24*b* of the second panel 16). Accordingly, debris entering any portion of the aperture 35 will either fall directly into the interior volume 15 or impact the shield member 19 and not the inner surface 40 of the second panel 16.

As illustrated in FIGS. 7A and 8, the shield member 19 may have an aperture 42 that may be defined by a perimeter edge 44, and the aperture 42 may at least partially overlap or align with the aperture 35 of the opening portion 34 of the panel assembly 12. The perimeter edge 44 of the aperture 42 of the shield member 19 may have any suitable shape to at least partially overlap or align with the aperture 35 of the opening portion 34 of the panel assembly 12. In some embodiments, the perimeter edge 44 of the aperture 42 of the shield member 19 may have the same shape or substantially the same shape as the perimeter edge 36 of the aperture 35 of the opening portion 34. For example, the perimeter edge 36 of the aperture 35 of the opening portion 34 may have a circular shape, and the perimeter edge 44 of the aperture 42 of the shield member 19 may have a circular shape. The center of the circular perimeter edge 44 may be horizontally equidistant from the first lateral edge 52 and the second lateral edge 54. So configured, the center of each of the aperture 35 and the aperture 44 may be axially aligned, and the diameter of the perimeter edge 36 of the aperture 35 may be equal to or substantially equal to the diameter of the perimeter edge 44 of the aperture 42. Alternatively, the diameter of the perimeter edge 36 of the aperture 35 may be less than or greater than the diameter of the perimeter edge 44 of the aperture 42. In other embodiments, the shield member 19 may not have an aperture 42, but may instead have a cut-out (not shown) that extends from one or more perimeter edges of the shield member 19, and the cut-out may have any suitable shape to avoid obstructing the aperture 35 of the panel assembly 12.

The shield member 19 may be secured to the panel assembly 12 in any suitable manner. In some embodiments, the shield member 19 is secured to the panel assembly 12 solely with mechanical means as will be described below in relation to FIGS. 7A and 7B, for example. In other embodiments, adhesive may alternatively or additionally be applied to one or more portions of the inside surface 64 of the shield member 19. For example, a perimeter of adhesive may be applied to one or both of the inside surface 64 of the shield member 19 and appropriate portions of the inner surface 38 of the first panel 14 and/or inner surface 40 of the second panel 16. The perimeter of adhesive may be inwardly offset from the perimeter edge 50 of the shield member 19. The perimeter of adhesive may have the same general shape as that of the perimeter edge 50 or may have a different shape, such as that of a circle, oval, or polygon. In other versions, the shield member 19 may be secured to the panel assembly 12 via other means, including for example, stitching, welding, clamping, etc.

Figure 6:
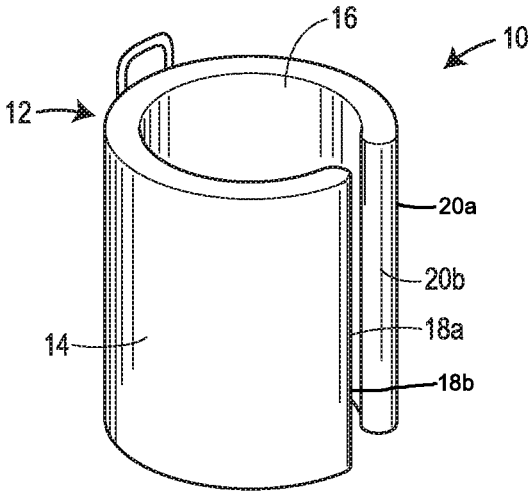
FIG. 6 is a perspective view, partially in section, of an embodiment of a vacuum cleaner bag assembly.

When disposed within the interior volume 115 of the tank 48, the panel assembly 12 (or a top portion of the panel assembly 12) wraps around at least a portion of the filter assembly 46, as illustrated in FIGS. 4 and 5. More specifically, as illustrated in FIG. 6 (in which the filter assembly 46 and tank 48 are omitted for clarity), the panel assembly 12 has a cylindrical shape, and the first lateral edge 18*a*, 18*b* of the first and/or the second panel 14, 16 may be adjacent to the second lateral edge 20*a*, 20*b* of the first and/or the second panel 14, 16. In some embodiments, the first lateral edge 18*a*, 18*b* of the first and/or the second panel 14, 16 may be directly adjacent to (or in contact with) the second lateral edge 20*a*, 20*b* of the first and/or the second panel 14, 16. In other embodiments, a circumferential gap may separate the first lateral edge 18*a*, 18*b* of the first and/or the second panel 14, 16 and the second lateral edge 20*a*, 20*b* of the first and/or the second panel 14. So configured, all or a portion of the shield member 19 may also wrap around a portion of the filter assembly 46 such that the shield member 19 has a partially circular cross-sectional shape in areas adjacent to the filter assembly 46, as illustrated in FIG. 5. So disposed, when viewed parallel to the Y-axis, the length of the circular segment between the first lateral edge 52 and the second lateral edge 54 may be between about 15% to about 50% of the total circumference of the filter assembly 46. In addition, the shield member 19 may vertically extend from the top portion 107 of the panel assembly 12 (e.g., the first transverse edge 22*b* of the second panel 16) to the bottom portion 62 of the filter assembly 12. Alternatively, the shield member 19 may vertically extend from the top portion 107 of the panel assembly 12 (e.g., the first transverse edge 22*b* of the second panel 16) to a portion of the panel assembly 12 (e.g., the second panel 16) disposed between the bottom portion 62 of the filter assembly 46 and a portion of the filter assembly 46 that is horizontally aligned with the bottom of the perimeter edge 36 defining the aperture 35 in the first panel 14.

Figure 7B:
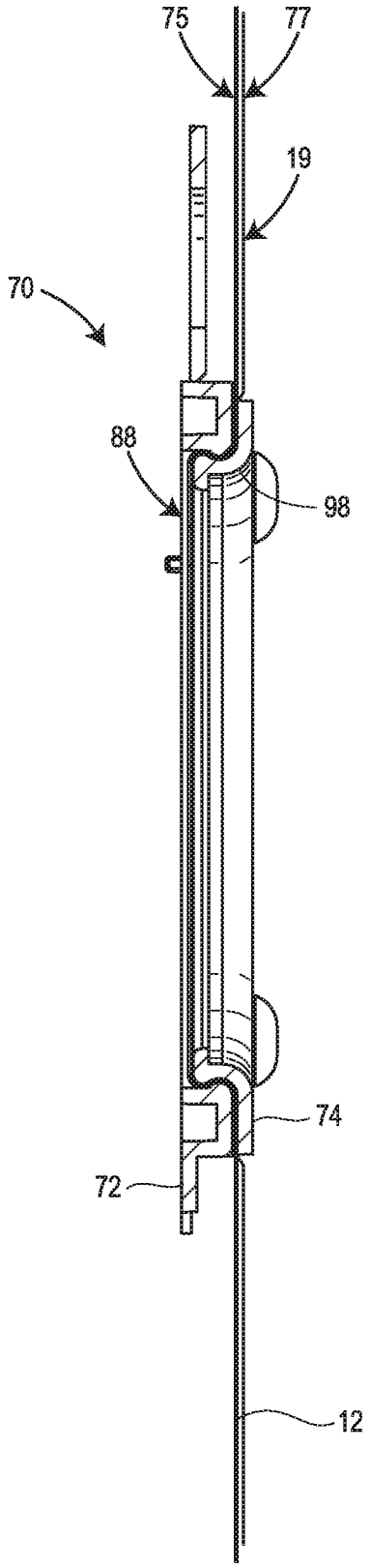
FIG. 7B is an sectional view of inlet assembly of the vacuum cleaner bag assembly of FIG. 1A.

As illustrated in FIGS. 1A, 7A, and 7B, the vacuum cleaner bag assembly 10 may also include a bracket assembly 70 for securing the shield assembly 19 to the panel assembly 12 and for providing a mechanism for attaching the bag assembly 10 to the vacuum. The bracket assembly 70 that may include a front plate 72 and a back plate 74. The front plate 72 may be planar or substantially planar and a rear side of the front plate 72 may be facing or in contact with an outer surface 86 (see FIG. 2) of the first panel 14. The front plate 72 may have engagement features adapted to engage the first end of the inlet coupling 47 that is coupled to the tank 48 and that is illustrated in FIG. 3. A gasket or seal 88 may be disposed between the rear side of the front plate 72 and the outer surface 86 of the first panel 14. The front plate 72 may have an aperture 76 defined by a cylindrical wall 78, and the cylindrical wall 78 may have any suitable shape. For example, the cylindrical wall 78 may have a circular shape and the outer diameter of the cylindrical wall 78 may be slightly greater than or equal to the diameter of the perimeter edge 36 of the aperture 35 of the panel assembly 12 and/or the perimeter edge 44 of the aperture 42 of the shield member 19 such that the cylindrical wall 78 is in contact with portions of the shield member 19 and panel assembly 12 adjacent to the apertures 35, 42. The cylindrical wall 78 may also be received into one of both of the apertures 42, 35. The outer diameter of the cylindrical wall 78 may be slightly larger than a diameter of an aperture 90 formed in the seal 88 such that portions of the seal 88 adjacent to the aperture 88 are in contact with the cylindrical wall 78.

As illustrated in FIGS. 1A and 7A, the front plate 72 may include a handle portion 80 that extends from a top portion of the front plate 72. The handle portion 80 may extend beyond the first transverse edge 22*a* of the first panel 14 of the panel assembly 12, and when the bracket assembly 70 is secured to the panel assembly 12, a user may lift the vacuum cleaner bag assembly 10 using the handle portion 80. As illustrated in FIG. 7A, the front plate 72 may further include a cap portion 82 that is adapted to removably or permanently mate with the cylindrical wall 78, and/or a cylindrical wall 84 of the back plate 74, and/or a portion of the panel assembly 12 to securely cover the aperture 76 and thereby prevent debris from exiting through the aperture 76 when disposing of the vacuum cleaner bag assembly 10.

As illustrated in FIGS. 1B, 7A, and 7B, the bracket assembly 70 may also include the back plate 74 that is disposed within the interior volume 15 of the panel assembly 12. More specifically, the shield member 19 and a portion of the panel assembly 12 (e.g., the first panel 14) and, optionally, the seal 88 may be disposed between the front plate 72 and the back plate 74. The back plate 74 may have a support portion 92 that may extend towards the first and second lateral edges 18*a*, 20*a* of the first panel 14. The support portion 92 may be elongated and may extend in a horizontal or substantially horizontal direction (i.e., parallel to the X-axis of the reference coordinate system of FIG. 1). In embodiments in which the shield member 19 is used, a first end of the support portion 92 may be disposed adjacent to the first lateral edge 52 of the shield member 19 and a second end of the support portion 92 may be disposed adjacent to the second lateral edge 54 of the shield member 19. In some embodiments, the first end of the support portion 92 may be disposed outward of (i.e., beyond) the first lateral edge 52 of the shield member 19 and the second end of the support portion 92 may be disposed outward of (i.e., beyond) the second lateral edge 54 of the shield member 19.

A perimeter portion 94 may downwardly extend from the support portion 92, and an aperture 96 may be defined by the cylindrical wall 84 of the perimeter portion 94. The cylindrical wall 84 of the back plate 74 may be sized to be received within the cylindrical wall 78 of the front plate 72 to sandwich portions of the shield member 19, the first panel 14, and, optionally, the seal 88 and adjacent to the respective apertures 42, 35, 90. Accordingly, the bracket assembly 70 may secure one or more portions of the shield member 19 to the panel assembly 12. The front plate 72 and the rear plate 74 may be coupled in any suitable manner, such as by mechanical fasteners, heat staking, and/or ultrasonic welding, or other means.

In operation, vacuum cleaner bag assembly 10 may be placed inside the tank 48 in a known manner, and the bracket assembly 70 (e.g., the front plate 72 of the bracket assembly 70) may be coupled to the first end of the inlet coupling 47 to allow debris exiting the outlet end 17 of the hose assembly 13 to be deposited in the interior volume 15 of the panel assembly 12. Debris entering the interior volume 15 of the panel assembly 12 will impact the shield member 19 disposed within the panel assembly 12 and adjacent to the downwardly-extending filter assembly 46, and the shield member 19 will thereby prevent debris from directly contacting the panel assembly 12. While various embodiments have been described above, this disclosure is not intended to be limited thereto. Variations can be made to the disclosed embodiments that are still within the scope of the appended claims.

What is claimed is:

1. A vacuum cleaner bag assembly adapted to be removably disposed within a vacuum cleaner, the vacuum cleaner bag assembly comprising:

a panel assembly comprising a first panel and a second panel forming an enclosure having an interior volume, wherein an aperture extends through the first panel, the aperture adapted to receive debris exiting an outlet end of a hose assembly such that the debris is retained within the interior volume, each of the first panel and the second panel including an outer sheet and a liner sheet, wherein each of the outer sheets comprises a first outer material and each of the liner sheets comprises a first liner material; and a shield member disposed within the interior volume and secured to one or more portions of the panel assembly, wherein the shield member comprises a second material that is different than each of the first outer material and the first liner material, the shield member extends vertically from a first point at or adjacent to a top portion of the panel assembly to a second point vertically disposed between a bottom portion of the aperture and a bottom portion of the panel assembly, the shield member is disposed opposite the aperture on the second panel and directly exposed to the aperture when the vacuum cleaner bag assembly is disposed within a tank such that the shield member protects a corresponding portion of the panel assembly from being impacted by debris passing through the aperture and into the interior volume;

wherein the first outer material is a wood pulp and polyester blend material and the first liner material is a non-woven, high efficiency filtration material, wherein the shield member includes a first portion and a second portion, the shield member being folded about a transverse axis that is disposed at or adjacent to the first point such that during normal operation, the first portion of the shield member abuts and applies a biasing force to the first panel of the panel assembly.

2. The vacuum cleaner bag assembly of claim 1, wherein each of the first outer material and the first liner material is a non-woven material.

3. The vacuum cleaner bag assembly of claim 1, wherein the first liner material is a polypropylene material.

4. The vacuum cleaner bag assembly of claim 3, wherein the first liner material is a polypropylene melt blown material.

5. The vacuum cleaner bag assembly of claim 1, wherein the second material is a flexible plastic.

6. The vacuum cleaner bag assembly of claim 1, wherein the second material does not include wood pulp.

7. The vacuum cleaner bag assembly of claim 1, wherein the shield member vertically extends from a point adjacent to a top portion of a filter assembly at least partially disposed within the tank to a point adjacent to a bottom portion of the filter assembly when the vacuum cleaner bag assembly is disposed within the tank.

8. The vacuum cleaner bag assembly of claim 1, wherein the shield member vertically extends from a point adjacent to a top portion of a filter assembly at least partially disposed within the tank to a point between the top portion of the filter assembly and a bottom portion of the filter assembly when the vacuum cleaner bag assembly is disposed within the tank.

9. The vacuum cleaner bag assembly of claim 1, wherein the shield member includes a first portion extending from the transverse axis to a first transverse edge and a second portion extending from the transverse axis to a second transverse edge.

10. The vacuum cleaner bag assembly of claim 9, wherein a vertical distance between the transverse axis and the first transverse edge is equal to a vertical distance between the transverse axis and the second transverse edge.

11. The vacuum cleaner bag assembly of claim 9, wherein a first securement feature is formed along or adjacent to a first lateral edge of the shield member from the transverse axis to the second transverse edge of the first portion, and wherein a second securement feature is formed along or adjacent to a second lateral edge of the shield member from the transverse axis to the second transverse edge of the first portion.

12. The vacuum cleaner bag assembly of claim 11, wherein each of the first securement feature and the second securement feature is a heat seal.

13. The vacuum cleaner bag assembly of claim 1, wherein a grain of the first outer material is vertically aligned.

14. The vacuum cleaner bag assembly of claim 13, wherein a dry strength of the first material is between about 11.6 lbs. and about 20.0 lbs.

15. The vacuum cleaner bag assembly of claim 14, wherein the dry strength of the first material is one of about 16.0 lbs., about 13.2 lbs., about 11.6 lbs., about 18 lbs., about 14.0 lbs., about 15.5 lbs., about 12.5 lbs., about 20.0 lbs., or about 16.4 lbs.

16. The vacuum cleaner assembly of claim 1, wherein a grain of the first outer material is vertically aligned.

17. The vacuum cleaner bag assembly of claim 1, wherein the aperture is adjacent a top of the panel assembly and a grain of the first material is generally vertically aligned.

18. The vacuum cleaner bag assembly of claim 1, wherein the first liner material is different than the first outer material.

19. A vacuum cleaner assembly comprising:

a tank having an interior volume;

a suction assembly coupled to a top portion of the tank;

a filter assembly coupled to the suction assembly and extending into the interior volume of the tank;

a hose assembly coupled to the tank;

a vacuum cleaner bag assembly removably disposed within the interior volume of the tank, the vacuum cleaner bag assembly comprising:

a panel assembly forming an enclosure having an interior volume, wherein an aperture extends through the panel assembly, the aperture adapted to receive debris exiting an outlet end of the hose assembly such that the debris is retained within the interior volume, the panel assembly comprising a first panel and a second panel, with each of the first panel and the second panel including an outer sheet and a liner sheet, wherein each of the outer sheets comprises a first outer material and each of the liner sheets comprises a first liner material; and a shield member disposed within the interior volume and secured to one or more portions of the panel assembly, wherein the shield member comprises a second material that is different than each of the first outer material and the first liner material, the shield member extending vertically from a first point at or adjacent to a top portion of the panel assembly to a second point vertically disposed between a bottom portion of the aperture and a bottom portion of the panel assembly, the shield member is disposed opposite the aperture in the panel assembly such that the shield member protects a corresponding portion of the panel assembly from being impacted by debris passing through the aperture and into the interior volume, wherein the first outer material is a non-woven wood pulp material and the first liner material is a non-woven polyester material, wherein the shield member includes a first portion and a second portion, the shield member being folded about a transverse axis that is disposed at or adjacent to the first point such that during normal operation, the first portion of the shield member abuts and applies a biasing force to the first panel of the panel assembly.

* * * * *